US005529590A

United States Patent [19]

Ennis et al.

[11] Patent Number: 5,529,590

[45] Date of Patent: Jun. 25, 1996

[54] PROCESS FOR THE MANUFACTURE OF ENDLESS COATED ABRASIVE ARTICLES

[75] Inventors: Mark R. Ennis; Robert M. Burgess, both of Hawkhurst, England

[73] Assignee: Minnesota Mining and Manufacturing Company, St. Paul, Minn.

[21] Appl. No.: 245,492

[22] Filed: May 19, 1994

[30] Foreign Application Priority Data

May 20, 1993 [GB] United Kingdom ..... 9310398

[51] Int. Cl.[6] ..... B24D 11/00

[52] U.S. Cl. ..... 51/298; 51/293; 51/297; 451/296; 451/531

[58] Field of Search ..... 156/189, 190, 156/304.1; 451/296, 531; 51/293, 297, 298

[56] References Cited

U.S. PATENT DOCUMENTS

| | | | |
|---|---|---|---|
| 766,930 | 8/1904 | Clemons | 24/38 |
| 1,009,709 | 11/1911 | Furber | 451/531 |
| 1,588,255 | 6/1926 | Maxwell | 24/38 |
| 1,728,673 | 9/1929 | Driver | 451/531 |
| 2,189,754 | 2/1940 | Cherrington | 451/489 |
| 2,391,731 | 12/1945 | Miller et al. | 451/489 |
| 2,445,807 | 7/1948 | Summers et al. | 451/489 |
| 2,733,181 | 1/1956 | Riedesel | 154/116 |
| 2,794,726 | 6/1957 | Riedesel et al. | 51/297 |
| 3,037,852 | 6/1962 | White | 51/293 |
| 3,154,897 | 11/1964 | Howard | 451/531 |
| 3,333,372 | 8/1967 | Gianatasio | 451/531 |
| 3,402,514 | 9/1968 | Johnson | 451/531 |
| 3,427,765 | 2/1969 | McGarvey | 451/531 |
| 3,524,779 | 8/1970 | Masters et al. | 156/190 |
| 3,533,876 | 10/1970 | Burgess | 156/304 |
| 3,643,387 | 2/1972 | Hilderbrand | 451/531 |
| 3,729,873 | 5/1973 | Sandell | 451/531 |
| 3,763,604 | 10/1973 | Malloy | 451/531 |
| 3,810,803 | 5/1974 | Karp et al. | 156/190 |
| 4,018,574 | 4/1977 | Dyer | 51/295 |
| 4,027,435 | 6/1977 | Malloy | 51/295 |
| 4,039,303 | 8/1977 | Yasushi et al. | 51/297 |
| 4,082,521 | 4/1978 | McGarvey | 51/297 |
| 4,194,618 | 3/1980 | Malloy | 206/205 |
| 4,215,516 | 8/1980 | Huschel et al. | 451/531 |
| 4,256,467 | 3/1981 | Gorsuch | 51/295 |
| 4,606,154 | 8/1986 | Herrmann et al. | 451/533 |
| 5,110,668 | 5/1992 | Minnick | 428/215 |

FOREIGN PATENT DOCUMENTS

| | | | |
|---|---|---|---|
| 0104531 | 10/1926 | Austria | 451/531 |
| 560413 | 7/1958 | Canada . | |
| 0013486 | 7/1980 | European Pat. Off. | B24D 11/00 |
| 0134545 | 3/1985 | European Pat. Off. | F16G 3/10 |
| 0237784 | 9/1987 | European Pat. Off. | B24D 3/20 |
| 0497451A2 | 8/1992 | European Pat. Off. | B24D 3/00 |
| 0508111 | 10/1920 | France | 451/531 |
| 2250049 | 5/1975 | France | F16G 3/10 |
| 2449743A | 9/1980 | France | D08H 5/00 |
| 0044490 | 4/1977 | Japan | 51/293 |
| 390717 | 8/1961 | Switzerland . | |
| 1340598 | 12/1973 | United Kingdom | C08G 22/04 |
| 1492789 | 11/1977 | United Kingdom | C09J 5/00 |
| 2094824 | 9/1982 | United Kingdom . | |
| 2200920 | 8/1988 | United Kingdom | B24D 11/00 |
| 2232636 | 12/1990 | United Kingdom | B29C 65/40 |
| WO93/12911 | 10/1992 | WIPO | B24D 11/00 |

*Primary Examiner*—Deborah Jones

*Attorney, Agent, or Firm*—Gary L. Griswold; Walter N. Kirn; Gregory D. Allen

[57] ABSTRACT

A method for making a spirally wound endless coated abrasive belt comprising an abrasive layer bonded to a backing laminate material comprising a flexible support and a hot-melt adhesive layer.

26 Claims, 1 Drawing Sheet

PROCESS FOR THE MANUFACTURE OF ENDLESS COATED ABRASIVE ARTICLES

FIELD OF THE INVENTION

This invention relates to a method for making endless coated abrasive articles. In particular, the invention relates to a method for making spiral wound endless coated abrasive belts.

DESCRIPTION OF THE RELATED ART

Endless coated abrasive articles, such as belts, sleeves, tubes and the like, are used in a variety of abrading operations thus requiring that they be made and supplied by the coated abrasive manufacturer in a large variety of widths and circumferences.

One type of endless coated abrasive belt has a width equal to the width of the coated abrasive material from which it was made. Typically, in the manufacture of these belts, a piece of coated abrasive material, equal in width to the desired belt width, is cut at a suitable angle to its longitudinal direction. In a direction lengthwise, a length equal to the desired belt circumference plus an allowance for forming a lap joint, if such a joint is to be formed, is measured off. A second cut is then made at the same angle as the first. To at least one of the cut ends, after skiving, adhesive composition is applied and the ends are then joined by overlapping and are caused to adhere to one another by means well known to those skilled in the art.

Alternatively, the piece of coated abrasive material may be cut to length without the allowance for overlap and the cut ends are butted and joined to one another with an overlapping reinforcing flexible patch suitably adhered to the backside of the two ends of the abrasive material.

Another alternative method for making a coated abrasive belt is disclosed in European Patent Appln. No. 0497451, published Aug. 5, 1992, wherein the method provides a coated abrasive belt comprising an abrasive layer bonded to a flexible backing material comprising a flexible support and a layer of hot-melt adhesive.

Another type of endless coated abrasive belt has a width that is greater than the width of coated abrasive material from which it was made. A conventional method for making such "spiral wound" belt involves winding an inner liner spirally on a mandrel having an outer circumference equal to the inside circumference of the desired abrasive belt, applying an adhesive to the outer surface of the inner liner, and winding spirally over the adhesive layer a strip of coated abrasive material. Such a method is widely used for the fabrication of belts in smaller sizes, up to, for example, 6 inches in diameter or 19 inches in circumference.

SUMMARY OF THE INVENTION

The present invention provides a method of making an endless coated abrasive belt, the method comprises the steps of:

(a) providing a strip of coated abrasive material comprising an abrasive layer having an exposed top surface and a bottom surface bonded to a major surface of a flexible backing laminate material, the strip having a substantially uniform thickness and width and parallel side edges, and the flexible backing material comprising a flexible support and a layer of hot-melt adhesive;

(b) winding the strip of coated abrasive material around a mandrel in a spiral configuration such that edges of the strip of adjacent turns of the spiral are in abutting engagement such that the top surfaces of the abrasive layers on each turn are aligned;

(c) heating the strip of coated abrasive material while maintaining the spiral configuration to a temperature sufficient to cause the hot-melt adhesive to flow across the abutted edges;

(d) allowing the strip of coated abrasive material to cool while maintaining the spiral configuration, whereby the hot-melt adhesive forms a continuous layer over the abutted edges and provides a tube; and, where necessary, (e) converting the tube from step (d) to provide one or more endless coated abrasive belts. In another aspect, the present invention provides a method for making an endless coated abrasive belt, the method comprising the steps of:

(a), providing a strip of flexible backing laminate material comprising a first flexible support and a first layer of hot-melt adhesive having an exposed major surface, and a strip of coated abrasive material comprising an abrasive layer having an exposed top surface and a bottom surface bonded to a major surface of a second backing laminate material comprising a second flexible support and a second hot-melt adhesive layer, each strip having a substantially uniform thickness and width and parallel side edges;

(b) winding the strip of flexible backing laminate material around a mandrel in a spiral configuration such that edges of the strip of flexible laminate material of adjacent turns of the spiral are in abutting engagement such that the exposed major surfaces of the hot-melt adhesive layer on each turn are aligned;

(c) winding the strip of coated abrasive material onto the exposed major surface of the strip of flexible laminate material in a spiral configuration opposite the spiral configuration resulting from step (b) such that edges of the strip of coated abrasive material of adjacent turns of the spiral are in abutting engagement such that the top surfaces of the abrasive layers on each turn are aligned;

(d) heating the strips while maintaining the spiral configurations to a temperature sufficient to cause the hot-melt adhesive from each of the strips to flow across the respective abutted edges;

(e) allowing the strips to cool while maintaining the spiral configurations, whereby the hot-melt adhesive forms a continuous layer over the abutted edges to provide a tube; and, where necessary, (f) converting the tube from step (e) to provide one or more endless coated abrasive belts.

The present invention provides a simple and effective method of making a dimensionally stable endless coated abrasive belt of substantially uniform thickness by butt joining the edges of a spirally wound elongate strip of coated abrasive material. The splice in the coated abrasive belt has sufficient strength to maintain the integrity of the belt during its use.

Coated abrasive belts prepared according to the method of the present invention can run evenly, equally well in either direction, and are found to have a good working life. Further, the method according to the present invention lends itself to the use of automated machinery. Moreover, as the splice of a coated abrasive belt prepared according to the method of the present invention has substantially the same thickness, density and flexibility as the remainder of the belt, the belt is less prone to premature wear in the joint region, thereby avoiding the problem of marking the workpiece, and it does not "bump" or "chatter" during use.

The coated abrasive belt may be in any conventional form including those having an abrasive layer comprising a make layer, abrasive granules or particles, a size layer, etc., and other functional layers (e.g., a supersize layer), and those having a monolayer as an abrasive layer comprising a slurry layer comprising a bond system and abrasive grain, and other functional layers. Preferably, the abrasive layer comprises a material (preferably, a mesh material) onto which is electroplated a layer of a metal, into which are embedded abrasive granules or particles.

Further, the abrasive layer may be noncontinuous or discontinuous, wherein the abrasive layer is made up of a repeating pattern of abrasive regions or abrasive islands comprising a bond system and abrasive grain. For an abrasive strip comprising such an abrasive layer, the thickness of the abrasive layer is determined by the thickness of the abrasive regions or abrasive islands. The thickness of such an abrasive strip is determined by the thickness where the abrasive regions or abrasive islands are present.

DETAILED DESCRIPTION OF PREFERRED EMDODIMENTS

Figure 1:
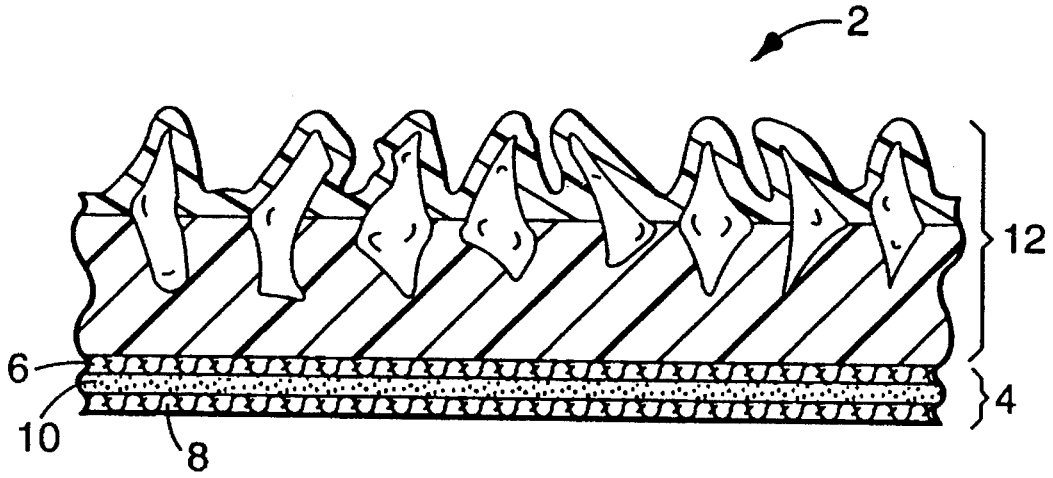
FIG. 1 represents a cross-section of a coated abrasive strip suitable for use in the method according to the present invention.

Referring to FIG. 1, coated abrasive strip 2 comprises flexible backing laminate material 4 having a major surface bearing an abrasive layer 12. Backing material 4 is formed from flexible supports 6 and 8 and layer of hot-melt adhesive 10, which is parallel to the major surface of backing material 4. Only one flexible support need be present but two flexible supports are preferred for strength and stability.

Abrasive layer 12 may comprise particles of abrasive mineral or grit embedded in one or more resin layers, or it comprises a layer of a material (e.g., mesh material) onto which is electrodeposited a layer of a metal (e.g., nickel), into which are embedded particles of abrasive mineral. The coated material is laminated onto the flexible support 6 of backing material 4, or alternatively, in the case of a single layer backing, hot-melt adhesive layer 10.

Figure 2:
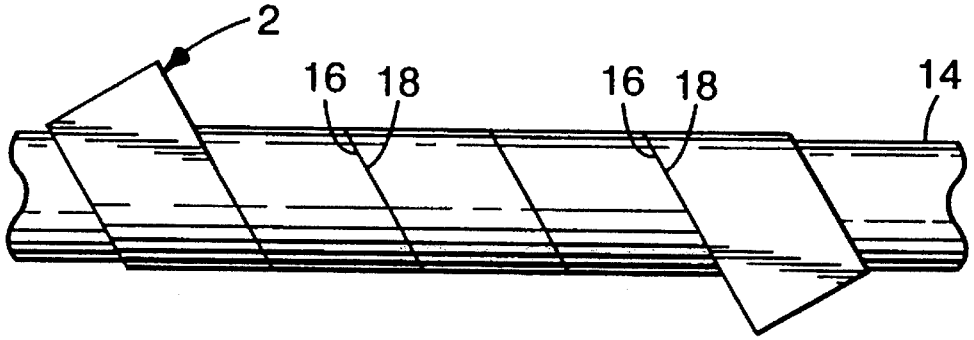
FIG. 2 represents a schematic illustration of a coated abrasive belt made by the method according to the present invention.

FIG. 2 shows strip of abrasive material 2 spirally wound on mandrel (e.g., an aluminum mandrel) 14. Preferably, the mandrel is polished (e.g., with a chrome, aluminum, metal polish such as that available from Autosol U.K. Ltd. under the trade designation "AUTOSOL') and coated with a mold release agent (e.g., that is available under the trade designation "FREKOTE 700NC" from Frekote Products of Manchester, England) prior to winding the strip. In order to maintain the spiral configuration, one end of strip 2 may be secured to the mandrel with a pressure sensitive adhesive tape (not shown). Mandrel 14 is then rotated (e.g., on a lathe), while guiding strip material 2 such that edges 16 and 18 of adjacent turns abut. After ensuring strip 2 is tightly wound, the free end is then secured to the mandrel with pressure-sensitive adhesive tape. If desired, the spiral butt joints may be covered (e.g., with pressure sensitive adhesive tape such as a tape commercially available from the 3M Company, St. Paul, Minn., under the trade designation "GREEN-TAPE NO 850" to prevent hot-melt adhesive flowing from the joint onto the abrasive layer.

The abrasive strip is heated to a temperature sufficient to melt the adhesive in the region immediately adjacent to the line of abutment and the pressure of the wound strip causes the melted adhesive to flow across the joint between each edge 16, 18. The strip is then cooled while continuing to maintain the spiral configuration so that the adhesive forms a continuous film or layer across the joint. This gives a strong joint having no significant variation in its thickness or flexibility when compared with the remainder of the belt.

The heating stage may be accomplished, for example, by placing the mandrel in an oven or by means of a heating element positioned within the mandrel. The temperature and heating time depend upon the particular adhesive employed, a typical temperature is about 145° C. to about 180° C. for a period of from 10 to 30 minutes.

The flexible supports of the backing material may comprise any suitable material known in the art including both woven and non-woven webs, papers, fabrics and cloths and polymeric films. The flexible support preferably comprises a web of a woven material.

The hot-melt adhesive is selected so that the melting temperature of the adhesive is above the operating temperature of the coated abrasive belt. For high temperature applications the hot-melt adhesive should have a melting point at or above 220° C., while for lower temperature applications, the melting point may be as low as 120° C. Polyurethane based adhesives are found to be particularly suitable for use in the present invention. The adhesive serves the functions of bonding the support layers together when the backing material comprises two support layers and in bonding the edges of the backing material together at the joint formed when assembling the belt.

The backing material preferably comprises two flexible support layers sandwiching a layer of a hot-melt adhesive. The backing material generally has a thickness in the range 0.5 to 2.5 mm, preferably 1.0 to 1.5 mm with a typical value of about 1.3 mm, and a weight of from 0.5 to 2.5 kg/m$^2$, preferably 0.75 to 2.5 kg/m$^2$ with a typical value of about 1.15 kg/m$^2$.

A suitable backing material can be provided, for example, by fusing a film or layer of hot-melt adhesive onto a flexible support. Optionally, a second flexible support can be fused to the hot-melt adhesive to provide a backing material having the hot-melt adhesive sandwiched between two flexible supports.

A preferred backing material is commercially available from Charles Walker & Co. Ltd., under the trade designation "BETALON TC13/NM," and comprises two woven polyester/cotton sheets with a layer of a polyurethane hot-melt adhesive therebetween. Another preferred backing material is commercially available from Charles Walker & Co. Ltd., under the trade designation "N35 BELT BACKER," and comprises layer of woven polyester fabric and a layer of a polyurethane hot-melt adhesive on one side (or major surface) thereof.

The backing may further comprise at least one of a presize (i.e., a barrier coat overlying the major surface of the backing onto which the abrasive layer is applied), a backsize (i.e., a barrier coat overlying the major surface of the backing opposite the major surface onto which the abrasive layer is applied), and a saturant (i.e., a barrier coat that is coated on all exposed surfaces of the backing). Preferably, the backing material comprises a presize. Suitable presize, backsize, or saturant materials are known in the art. Such materials include, for example, resin or polymer latices, neoprene rubber, butylacrylate, styrol, starch, hide glue, and combinations thereof.

With the exception of the specified steps of the method according to the present invention, the coated abrasive belt can be prepared using materials and techniques known in the art for constructing coated abrasive articles.

The preferred bond system (i.e., for a slurry coat or make coat and size coat) is a resinous or glutinous adhesive. Examples of typical resinous adhesives include phenolic resins, urea-formaldehyde resins, melamine-formaldehyde resin, epoxy resins, acrylate resins, urethane resins, and combinations thereof. The bond system may contain other additives which are well known in the art, such as, for example, grinding aids, plasticizers, fillers, coupling agents, wetting agents, dyes, and pigments.

Examples of useful materials which may be used in the supersize coat include the metal salts of fatty acids, urea-formaldehyde, novalak phenolic resins, waxes, mineral oils, and fluorochemicals. The preferred supersize is a metal salt of a fatty acid such as, for example, zinc stearate.

In the first preferred conventional method for preparing a coated abrasive article, a make coat is applied to a major surface of the backing following by projecting a plurality of abrasive granules into the make coat. It is preferable in preparing the coated abrasive that the abrasive granules be electrostatically coated. The make coating is cured in a manner sufficient to at least partially solidify it such that a size coat can be applied over the abrasive granules. Next, the size coat is applied over the abrasive granules and the make coat. Finally, the make and size coats are fully cured. Optionally, a supersize coat can be applied over the size coat and cured.

In the second preferred conventional method for preparing a coated abrasive article, a slurry containing abrasive granules dispersed in a bond material is applied to a major surface of the backing. The bond material is then cured. Optionally, a supersize coat can be applied over the slurry coat and cured.

In the above methods, the make coat and size coat or slurry coat can be solidified or cured by means known in the art, including, for example, heat or radiation energy.

Suitable methods for providing the abrasive layer also include providing a flowable intimate mixture of resin and abrasive mineral or material, applying the mixture through masking means directly onto a major surface of the backing material or flexible support, and curing the resin. The masking means comprises a plurality of openings corresponding to discrete areas of the backing material or flexible support to which the mixture is to be applied. Preferred abrasive minerals for this method include nickel and diamond. Preferred resins for this method include epoxy resins (including two-part epoxy resins) such as those available under the trade designations "XZ06," "XZ09," "XZ15," "XZ-16," "XZ-17," "XZ39," and "XZ40" from Coates Special Products Limited, and those available under the trade designations "2001, " "2002," "2004", "2005," "2006," "AV 121," "AV 123B," "AV 129," "AV 133," "HV 133," and "AV 138." For additional details regarding this method of providing an abrasive layer, see U.K. Pat. No. 2,094,824, published Sep. 22, 1982, the disclosure of which is incorporated herein by reference.

For an abrasive layer comprising a layer of a mesh material onto which is electrodeposited a layer of metal e.g., nickel), into which are embedded abrasive granules, the coated mesh material is typically laminated onto a major surface of the backing material, or alternatively, in the case of a single layer backing onto the adhesive layer.

The preparation of suitable electrodeposited abrasive layers is known in the art and disclosed, for example, in U.S. Pat. No. 4,256,467 (the disclosure of which is incorporated herein by reference for its teaching of a coated abrasive belt having an abrasive layer comprising a mesh with abrasive grain attached thereto), British Pat. No. 2200920, and European Pat. No. 13486. Generally, such an abrasive layer is formed by laying a length of mesh material onto an electrically conducting surface and electrodepositing a metal onto the mesh material in the presence of abrasive granules such that the abrasive granules become embedded in the metal. If a pattern of abrasive granules is desired, an insulating material is selectively applied to the mesh material before deposition of the metal layer so that the metal can only deposit onto the mesh in those areas not covered by the insulating material, thereby defining the pattern of the abrading surface.

In one method of making an electrodeposited abrasive layer, a mesh material in the form of a woven fabric of electrically insulating material, such as nylon, cotton or terylene, is screen printed with an ink comprising an insulating material, wherein the ink is compatible with any hot-melt adhesive which may subsequently be applied to the abrasive layer to secure it to the backing material. Preferably, the ink is resin based or oil based ink. The ink may be colored as desired. Typically, the insulating material is waterproof and acid resistant. Preferably, the insulating material is color fast at elevated working temperatures of the abrasive article (e.g., up to about 220° C).

Conventional screen printing techniques may be used to print the ink onto the mesh. If a pattern of abrasive granules is desired, the screen printing technique used must ensure that the ink penetrates into and is absorbed onto defined areas of the mesh material such that discrete areas with and without ink are provided. Such discrete areas may be of any convenient shape and size, including, for example, circles, diamonds, squares, rectangles, etc.

The abrasive layer comprising the mesh material can be adhered to the backing material by applying a layer of adhesive to either the abrasive layer or the backing material. The adhesive material is then cured, or in the case of a hot-melt adhesive, heated and then cooled. Preferably, the adhesive is acid resistant and water repellent. Suitable adhesives include, for example, that marketed under the trade designation "BOSTICK 3206" by Bostick Limited of Leicester, United Kingdom.

In another method, the ink may be combined with an adhesive and screen printed onto the mesh material. The metal and abrasive is deposited, as described above, and the resulting abrasive layer may be applied to the backing material and the adhesive material, cured, or in the case of a hot-melt adhesive, heated and then cooled. Preferably, the adhesive is acid resistant and water repellant.

In another method, instead of the insulating material being an ink or an ink and an adhesive, a hot-melt adhesive only is used as the insulating material. Preferably, the hot-melt adhesive is acid resistant and water repellent. The hot-melt adhesive may be, for example, a sheet which is applied to the mesh material before electrodeposition. Typically, the adhesive sheet has a plurality of openings of desired shape and size. The hot-melt adhesive sheet is placed in contact with the mesh material and heated while applying sufficient pressure to cause the adhesive to absorb and enter the spaces of the mesh material. When the mesh material is fully penetrated, the resulting composite is cooled. The mesh material is then electrodeposited with metal and abrasive as described above. The resulting abrasive layer has adhesive on both sides of the mesh material, and surrounding the metal areas, the abrasive layer can be readily adhered to the backing material by applying sufficient heat through the surface of the backing material opposite that onto which the abrasive layer is to cause the adhesive to adhere the mesh material to the backing material.

The abrasive mineral or material may be of any particle size and any type useful for coated abrasive belts including flint, cork, vermiculite, quartz, garnet, silicon carbide, diamond, cubic boron nitride, boron carbide, alumina (including fused alumina, heat-treated fused alumina, and ceramic alumina (e.g., sol-gel derived alumina)), fused aluminazirconia, and combinations thereof.

The method according to the present invention is particularly useful in making belts which are intended to be used over drums or wheels. Such belts have relatively small diameters (e.g., 15, 22, 25, 30, 45, 50 and 60 mm), which are not readily fabricated by employing an end-to-end (butt) splicing technique. The method according to the present invention readily allows production of a tube of coated abrasive material from which several of such belts may be cut. The width of the strip of abrasive material is generally similar to the diameter of the mandrel. The coated abrasive tube can be used directly as a belt or band if it is of the desired dimensions. Normally, however, the coated abrasive tube is converted into one or more belts, for example, by cutting or trimming. Typically, an abrasive tube is converted into a plurality of belts (e.g., 4 or more). The width of the belt are preferably less than 50mm and generally ranges from 20 to 42 mm.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A method of making an endless coated abrasive belt, said method comprises the steps of:

(a) providing a strip of coated abrasive laminate material comprising an abrasive layer having an exposed top surface and a bottom surface bonded to a major surface of a flexible backing laminate material, said strip having a substantially uniform thickness and parallel side edges and said flexible backing laminate material comprising a flexible support and a layer of hot-melt adhesive;

(b) winding said strip of coated abrasive material around a mandrel in a spiral configuration such that edges of said strip of adjacent turns of said spiral are in abutting engagement;

(c) heating said strip of coated abrasive material while maintaining said spiral configuration to a temperature sufficient to cause said hot-melt adhesive to flow across the abutted edges;

(d) allowing said strip of coated abrasive material to cool while maintaining said spiral configuration, whereby said hot-melt adhesive forms a continuous layer over said abutted edges; and (e) trimming or cutting to provide at least one endless coated abrasive belt.

2. A method as claimed in claim 1 in which said flexible backing laminate material comprises two flexible support layers with said layer of hot-melt adhesive being interposed between said flexible support layers.

3. A method as claimed in claim 1 in which said flexible support layer comprises a woven web, and said hot-melt adhesive has a melting point of at least 120° C.

4. A method as claimed in claim 1 in which said hot-melt adhesive has a melting point of at least 220 C.

5. A method as claimed in claim 1 in which said hot-melt adhesive is a polyurethane adhesive.

6. A method as claimed in claim 1 in which said spiral configuration is maintained by securing each end of said coated abrasive strip to said mandrel by adhesive tape.

7. A method as claimed in claim 1 in which abutting edges of said strip of coated abrasive material are covered with adhesive tape prior to said heating step and wherein said adhesive tape is removed after said cooling step.

8. A method of making an endless coated abrasive belt, said method comprises the steps of:

(a) providing a strip of coated abrasive material comprising an abrasive layer having an exposed top surface and a bottom surface bonded to a major surface of a flexible backing laminate material, said strip having a substantially uniform thickness and parallel side edges, and said flexible backing laminate material comprising a flexible support and a layer of hot-melt adhesive;

(b) winding said strip of coated abrasive material around a mandrel in a spiral configuration such that edges of said strip of adjacent turns of said spiral are in abutting engagement;

(c) heating said strip of coated abrasive material while maintaining said spiral configuration to a temperature sufficient to cause said hot-melt adhesive to flow across the abutted edges; and (d) allowing said strip of coated abrasive material to cool while maintaining said spiral configuration, whereby said hot-melt adhesive forms a continuous layer over said abutted edges to provide an endless coated abrasive belt.

9. A method as claimed in claim 8 in which said flexible backing material comprises two flexible support layers with said layer of hot-melt adhesive being interposed between said flexible support layers.

10. A method as claimed in claim 8 in which said flexible support layer comprises a woven web, and said hot-melt adhesive has a melting point of at least 120° C.

11. A method as claimed in claim 8 in which said hot-melt adhesive has a melting point of at least 220° C.

12. A method as claimed in claim 8 in which said hot-melt adhesive is a polyurethane adhesive.

13. A method as claimed in claim 8 in which said spiral configuration is maintained by securing each end of said coated abrasive strip to said mandrel by adhesive tape.

14. A method as claimed in claim 8 in which abutting edges of said strip of coated abrasive material are covered with adhesive tape prior to said heating step and wherein said adhesive tape is removed after said cooling step.

15. A method for making an endless coated abrasive belt, said method comprising the steps of:

(a) providing a strip of flexible backing laminate material comprising a first flexible support and a first layer of hot-melt adhesive having an exposed major surface, and a strip of coated abrasive material comprising an abrasive layer having an exposed top surface and a bottom surface bonded to a major surface of a second backing laminate material comprising a second flexible support and a second hot-melt adhesive layer, each strip having a substantially uniform thickness and parallel side edges;

(b) winding said strip of flexible backing laminate material around a mandrel in a spiral configuration such that edges of said strip of flexible laminate material of adjacent turns of the spiral are in abutting engagement (c) winding said strip of coated abrasive material onto the exposed major surface of said strip of flexible laminate material in a spiral configuration opposite the spiral configuration resulting from step (b) such that edges of said strip of coated abrasive material of adjacent turns of the spiral are in abutting engagement;

(d) heating said strips while maintaining said spiral configurations to a temperature sufficient to cause said hot-melt adhesive from each of said strips to flow across the respective abutted edges;

(e) allowing said strips to cool while maintaining said spiral configurations, whereby said hot-melt adhesive forms a continuous layer over the abutted edges to provide an endless coated abrasive belt.

16. A method as claimed in claim 15 in which said flexible support layer comprises a woven web, and said hot-melt adhesive has a melting point of at least 120° C.

17. A method as claimed in claim 15 in which said hot-melt adhesive has a melting point of at least 220° C.

18. A method as claimed in claim 15 in which said hot-melt adhesive is a polyurethane adhesive.

19. A method as claimed in claim 15 in which said spiral configuration is maintained by securing each end of said coated abrasive strip to said mandrel by adhesive tape.

20. A method as claimed in claim 15 in which abutting edges of said strip of coated abrasive material are covered with adhesive tape prior to said heating step and wherein said adhesive tape is removed after said cooling step.

21. A method for making an endless coated abrasive belt, said method comprising the steps of:

(a) providing a strip of flexible backing laminate material comprising a first flexible support and a first layer of hot-melt adhesive having an exposed major surface, and a strip of coated abrasive material comprising an abrasive layer having an exposed top surface and a bottom surface bonded to a major surface of a second backing laminate material comprising a second flexible support and a second hot-melt adhesive layer, each strip having a substantially uniform thickness and parallel side edges;

(b) winding said strip of flexible backing laminate material around a mandrel in a spiral configuration such that edges of said strip of flexible laminate material of adjacent turns of the spiral are in abutting engagement;

(c) winding said strip of coated abrasive material onto the exposed major surface of said strip of flexible laminate material in a spiral configuration opposite the spiral configuration resulting from step (b) such that edges of said strip of coated abrasive material of adjacent turns of the spiral are in abutting engagement;

(d) heating said strips while maintaining said spiral configurations to a temperature sufficient to cause said hot-melt adhesive from each of said strips to flow across the respective abutted edges;

(e) allowing said strips to cool while maintaining said spiral configurations, whereby said hot-melt adhesive forms a continuous layer over the abutted edges; and (f) trimming or cutting to provide at least one endless coated abrasive belt.

22. A method as claimed in claim 21 in which said flexible support layer comprises a woven web, and said hot-melt adhesive has a melting point of at least 120° C.

23. A method as claimed in claim 21 in which said hot-melt adhesive has a melting point of at least 220° C.

24. A method as claimed in claim 21 in which said hot-melt adhesive is a polyurethane adhesive.

25. A method as claimed in claim 21 in which said spiral configuration is maintained by securing each end of said coated abrasive strip to said mandrel by adhesive tape.

26. A method as claimed in claim 21 in which abutting edges of said strip of coated abrasive material are covered with adhesive tape prior to said heating step and wherein said adhesive tape is removed after said cooling step.

* * * * *